US009905929B2

(12) United States Patent
Hsu

(10) Patent No.: US 9,905,929 B2
(45) Date of Patent: Feb. 27, 2018

(54) MICROSTRIP ANTENNA TRANSCEIVER

(71) Applicant: Wistron NeWeb Corporation, Hsinchu (TW)

(72) Inventor: Chieh-Sheng Hsu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 0 days.

(21) Appl. No.: 14/918,547

(22) Filed: Oct. 20, 2015

(65) Prior Publication Data

US 2016/0211580 A1 Jul. 21, 2016

(30) Foreign Application Priority Data

Jan. 21, 2015 (TW) ..... 104102010 A

(51) Int. Cl.
*H01Q 9/04* (2006.01)
*H01Q 21/24* (2006.01)

(52) U.S. Cl.
CPC ..... *H01Q 9/045* (2013.01); *H01Q 21/245* (2013.01)

(58) Field of Classification Search
CPC ..... H01Q 9/045; H01Q 21/245
See application file for complete search history.

(56) References Cited

U.S. PATENT DOCUMENTS 4,410,891 A 10/1983 Schaubert
5,270,722 A 12/1993 Delestre
6,492,947 B2 12/2002 Anderson
7,053,833 B2 5/2006 Hsu
7,253,770 B2 8/2007 Yegin
7,327,317 B2 2/2008 Heiniger
7,391,377 B2 6/2008 Matsushita
(Continued)

FOREIGN PATENT DOCUMENTS

CN 202363587 U 8/2012
TW 200818599 4/2008
TW 201431302 A 8/2014

OTHER PUBLICATIONS

E. Ramola et al., "Reconfigurable Microstrip Patch Antenna using MEMS Technology," IOSR Journal of Electronics and Communication Engineering (IOSR-JECE), vol. 4, Issue 4 (Jan.-Feb. 2013), pp. 44-51.

(Continued)

*Primary Examiner* — Andrea Lindgren Baltzell
(74) *Attorney, Agent, or Firm* — Winston Hsu

(57) ABSTRACT

A microstrip antenna transceiver with switchable polarizations includes a substrate, a first switch element, a second switch element and an antenna module. The first switch element and the second switch element are disposed on a first surface of the substrate; the antenna module is disposed on a second surface of the substrate and includes a radiation patch including a first pattern slot, a vertical polarization feed-in point and a horizontal polarization feed-in point. The vertical polarization feed-in point and the horizontal polarization feed-in point are symmetric with respect to a symmetrical axis. Size and displacement of the first pattern slot are related to reflection phase of the first switch element and the second switch element in order to generate a right-handed polarized signal or a left-handed polarized signal.

8 Claims, 14 Drawing Sheets

(56) References Cited

U.S. PATENT DOCUMENTS

| | | | | |
|---|---|---|---|---|
| 7,535,326 | B2 * | 5/2009 | Nakatani | H01H 57/00 200/181 |
| 7,609,211 | B2 | 10/2009 | Hsu | |
| 7,952,525 | B2 | 5/2011 | Hirabayashi | |
| 8,373,609 | B1 * | 2/2013 | Dorsey | H01Q 21/245 343/769 |
| 8,648,770 | B2 | 2/2014 | Schneider | |
| 8,698,575 | B2 | 4/2014 | Bloy | |
| 9,024,839 | B2 | 5/2015 | Schneider | |
| 2008/0266192 | A1 | 10/2008 | Tuttle | |
| 2011/0032079 | A1 | 2/2011 | Bloy | |
| 2014/0203968 | A1 | 7/2014 | Hsu | |
| 2014/0320376 | A1 | 10/2014 | Ozdemir | |

OTHER PUBLICATIONS

H. Rajagopalan et al., "Reconfigurable Patch-Slot Reflectarray Elements using RF MEMS Switches: A Subreflector Wavefront Controller," IEEE Antennas and Propagation Society International Symposium, 2007, pp. 5203-5206.

Hsu, Title of Invention: Planar Dual Polarization Antenna and Complex Antenna, U.S. Appl. No. 14/700,150, filed Apr. 30, 2015.

* cited by examiner

MICROSTRIP ANTENNA TRANSCEIVER

BACKGROUND OF THE INVENTION

1. Field of the Invention

The present invention provides a microstrip antenna transceiver which is capable of switching polarizations.

2. Description of the Prior Art

Satellite communication has advantages of huge coverage and no interference caused by ground environments, and is widely used in military applications, detection and commercial communications services such as satellite navigation, a satellite voice broadcast system or a satellite television broadcast system. Nowadays, many electronic devices, such as smart phones, tablet personal computers, and so on can receive satellite signals via an external antenna. In general, the frequency of satellite signals ranges from 1.466 GHz to 1.472 GHz and two orthogonal signals are provided within the band at the same time, wherein one of the orthogonal signals is a left-handed polarized signal and the other is a right-handed polarized signal. Therefore, a left-handed polarized antenna module and a right-handed polarized antenna module are required to receive the two orthogonal signals. However, practically, an electronic device does not handle the two orthogonal signals at the same time and only selects one. Moreover, two independent antenna modules occupy much space and increase the cost, so the left-handed polarized antenna module and the right-handed polarized antenna module are preferably combined to one antenna module.

A conventional antenna transceiver comprises two switch elements, a hybrid circuit and a patch antenna. The hybrid circuit comprises two input transmission ports and two output transmission ports. When the two switch elements are not conducted simultaneously (i.e., only one switch element is turned on at a time) and control a signal received to enter the hybrid circuit via only one of the input transmission ports, the hybrid circuit equally partitions the signal into two transmission signals with a phase difference of 90 degrees, and then transmits the two transmission signals to the patch antenna through the two output transmission ports, respectively. Then, the patch antenna generates a vertically polarized signal and a horizontally polarized signal and radiates the vertically polarized signal and the horizontally polarized signal to the air. Since the phases of the two transmission signals have a 90-degree phase difference, a left-handed polarized antenna pattern or a right-handed polarized antenna pattern can be formed. Two feed-in points of the patch antenna are connected to two output transmission ports respectively; therefore, vertically polarized and horizontally polarized electromagnetic fields are generated after the two transmission signals equally partitioned from the signal enter the patch antenna. Besides, since the patch antenna is vertically and horizontally symmetric, energy of the vertically polarized signal and the horizontally polarized signal are not mutually affected.

As seen above, the conventional antenna transceiver has high isolation for two orthogonal signals. However, the length and width of the hybrid circuit need to be ¼ wavelength in order to perform the hybrid circuit, so that the hybrid circuit requires large plate area and the cost is increased for the present satellite signals of low frequency. Therefore, how to reduce the cost of the antenna and handle the two orthogonal signals at the same time becomes a goal in the industry.

SUMMARY OF THE INVENTION

The present invention is related to a microstrip antenna transceiver, and more particularly, to a microstrip antenna transceiver which is capable of switching polarizations.

An embodiment of the present invention discloses a microstrip antenna transceiver with switchable polarizations, comprising a substrate comprising a first surface and a second surface; a first switch element disposed on the first surface of the substrate; a second switch element disposed on the first surface of the substrate; and an antenna module disposed on the second surface of the substrate comprising a radiation patch comprising a first pattern slot wherein a size and a displacement of the first pattern slot are related to a reflection phase of the first switch element and a reflection phase of the second switch element in order to generate a right-handed polarized signal or a left-handed polarized signal; a vertical polarization feed-in point; and a horizontal polarization feed-in point wherein the vertical polarization feed-in point and the horizontal polarization feed-in point are symmetric with respect to a symmetrical axis; a first microstrip line is electrically connected between the vertical polarization feed-in point and the first switch element; and a second microstrip line is electrically connected between the horizontal polarization feed-in point and the second switch element.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
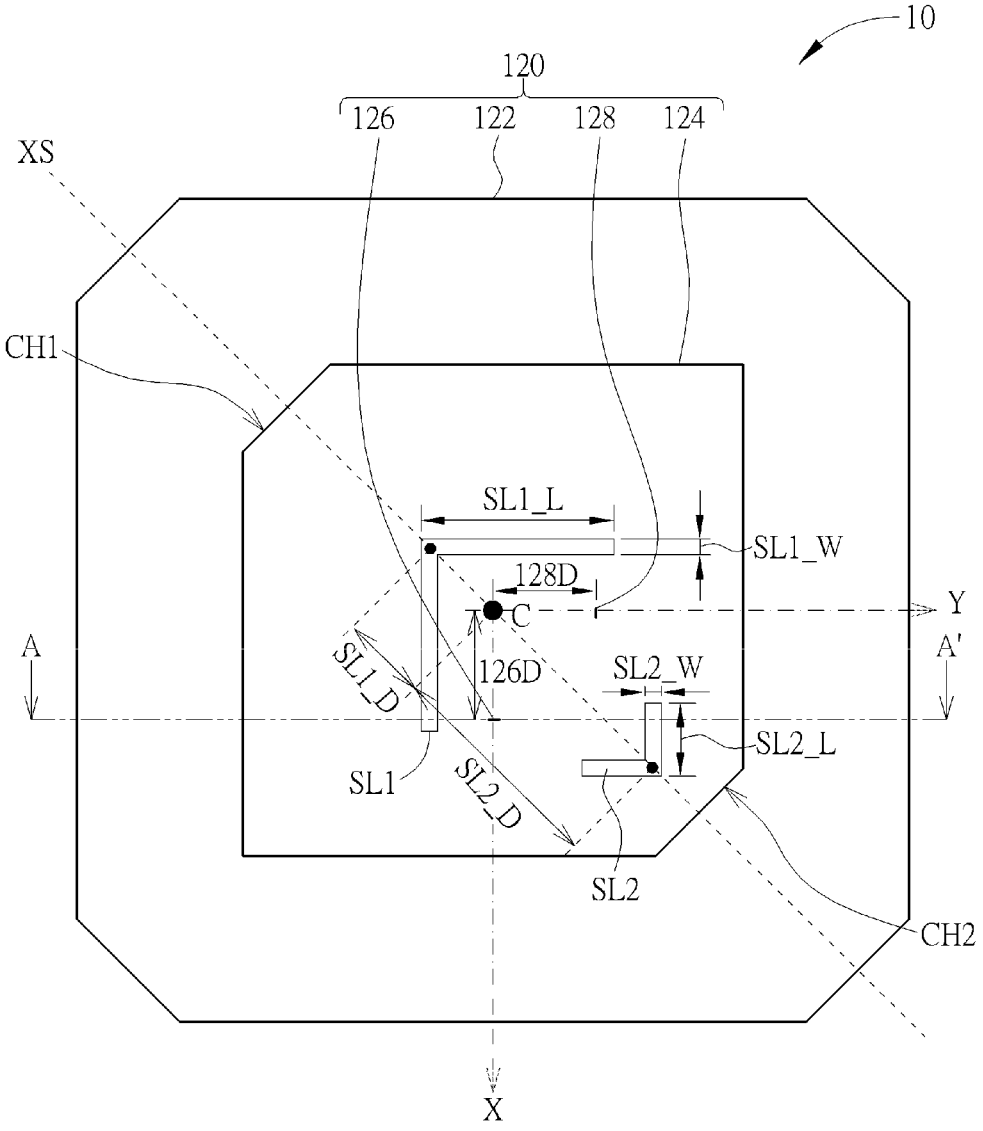
FIG. 1A is a schematic diagram illustrating a top view of a front surface of a microstrip antenna transceiver according to an embodiment of the present invention.
Figure 1B:
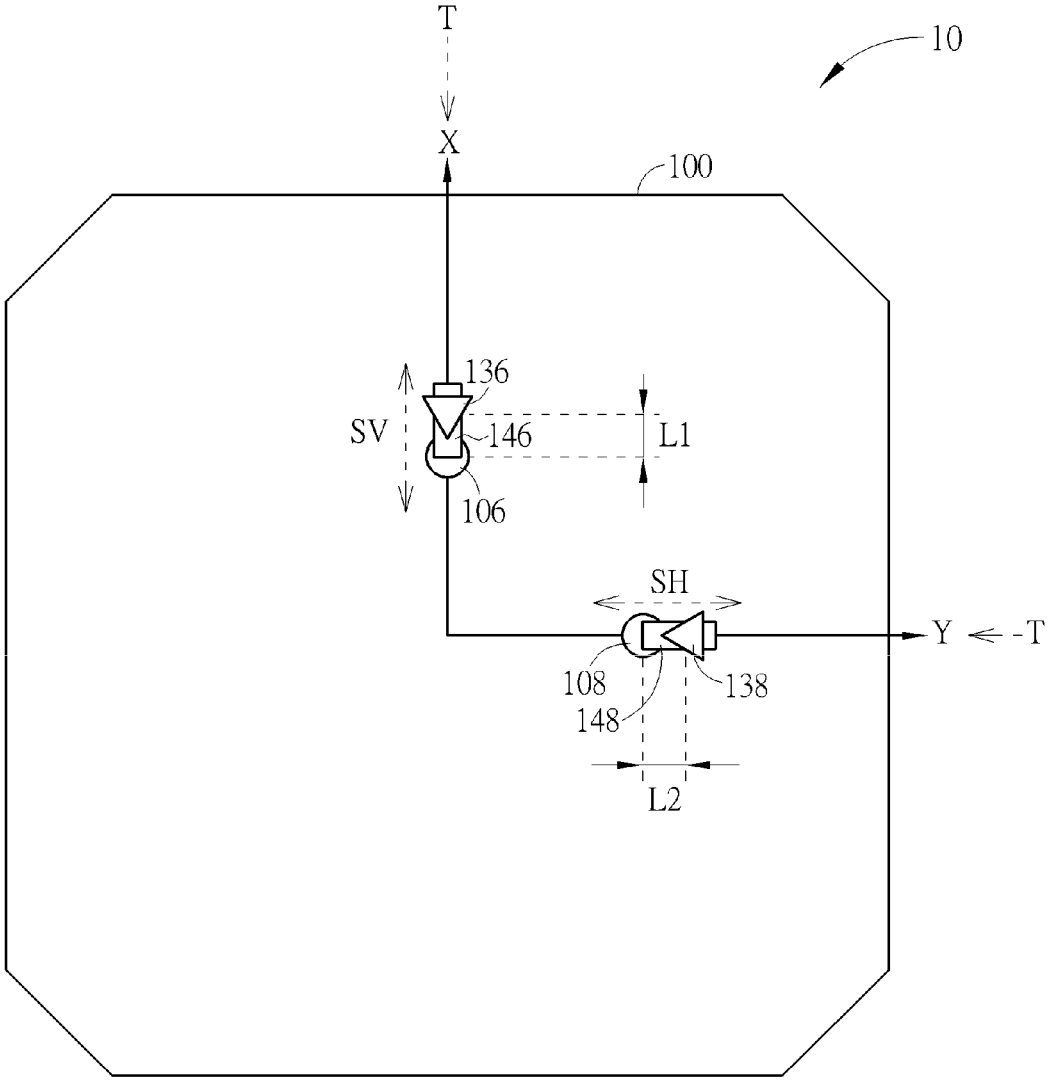
FIG. 1B is a schematic diagram illustrating a top view of a back surface of the microstrip antenna transceiver shown in FIG. 1A.
Figure 1C:
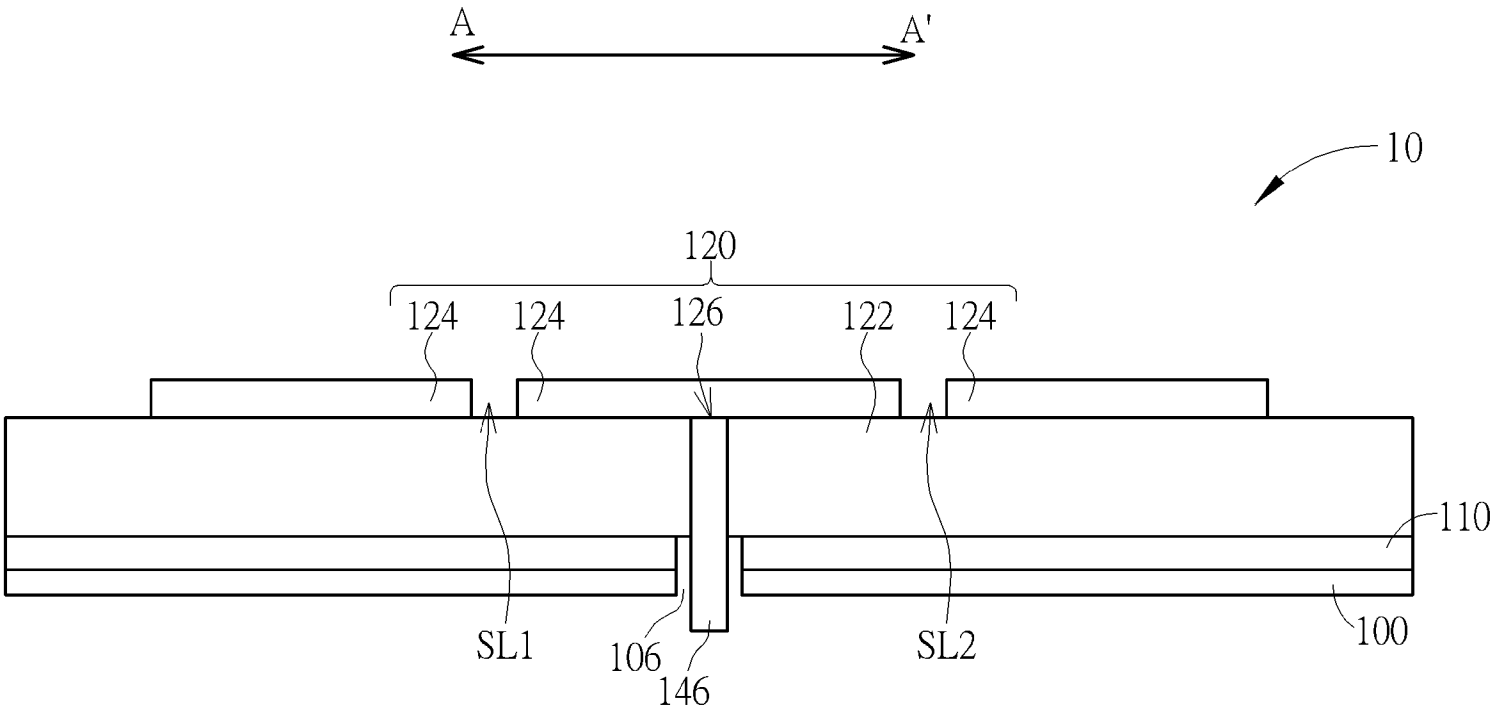
FIG. 1C is a cross-sectional view diagram of the microstrip antenna transceiver 10 taken along a cross-sectional line A-A' in FIG. 1A.

FIG. 1A is a schematic diagram illustrating a top view of a front surface of a microstrip antenna transceiver 10 according to an embodiment of the present invention. FIG. 1B is a schematic diagram illustrating a top view of a back surface of the microstrip antenna transceiver 10. FIG. 1C is a cross-sectional view diagram of the microstrip antenna transceiver 10 taken along a cross-sectional line A-A' in FIG. 1A. The microstrip antenna transceiver 10 comprises a substrate 100, a metal grounding plate 110, an antenna module 120, switch elements 136, 138, microstrip lines 146 and 148. The switch elements 136, 138 are disposed on one side of the substrate 100, and the metal grounding plate 110 and the antenna module 120 are disposed on the other side of the substrate 100. The metal grounding plate 110 is disposed between the antenna module 120 and the substrate 100. The antenna module 120 comprises a dielectric layer 122, a radiation patch 124, a vertical polarization feed-in point 126 and a horizontal polarization feed-in point 128. The dielectric layer 122 is utilized to electrically isolate the metal grounding plate 110 from the radiation patch 124. The radiation patch 124 is the main radiating body by which electromagnetic waves resonate along a vertical direction X or a horizontal direction Y, such that a vertically polarized signal SV or a horizontally polarized signal SH radiates. The shape of the radiation patch 124 of the antenna module 120 is substantially conforming to a hexagon symmetric with respect to a symmetrical axis XS, and more precisely, is a quadrilateral with two opposite corners chamfered to form cutting corners CH1 and CH2 for controlling energy transformation between the vertically polarized signal SV and the horizontally polarized signal SH of the antenna module 120. The radiation patch 124 comprises pattern slots SL1, SL2 for adjusting the phase difference between the vertically polarized signal SV and the horizontally polarized signal SH to produce a right-handed polarized signal or a left-handed polarized signal. The pattern slots SL1, SL2 are symmetric with respect to the symmetrical axis XS, and are disposed on the opposite sides of a line connecting the vertical polarization feed-in point 126 to the horizontal polarization feed-in point 128, respectively.

The vertical polarization feed-in point 126 and the horizontal polarization feed-in point 128 are symmetric with respect to the symmetrical axis XS. The microstrip line 146 is electrically connected between the vertical polarization feed-in point 126 and the switch element 136 through an opening 106 of the substrate 100, and thus transmits or receives the vertically polarized signal SV with the antenna module 120 controlled by the switch element 136. The microstrip line 148 is electrically connected between the horizontal polarization feed-in point 128 and the switch element 138 through an opening 108 of the substrate 100, and thus transmits or receives the horizontally polarized signal SH with the antenna module 120 controlled by the switch element 138. The lengths of the microstrip lines 146, 148 are substantially the shortest distance from the substrate 100 to the vertical polarization feed-in point 126 or the horizontal polarization feed-in point 128. Moreover, distances L1, L2 of the microstrip lines 146, 148 from the switch elements 136, 138 to the openings 106, 108 are approximately zero—namely, the microstrip lines 146, 148 merely electrically connects one element to another without changing signal phase, thereby providing a relative small sized microstrip antenna transceiver 10, reducing energy loss of the microstrip lines 146, 148, improving antenna gain, and avoiding noise.

Briefly, the microstrip antenna transceiver 10 transmits or receives signals of different polarizations (i.e. left-handed polarized signals and right-handed polarized signals) by controlling the switch elements 136, 138, such that the microstrip antenna transceiver 10 can handle signals of different polarizations by switching in order to save costs and in order to handle signals of different polarizations with the same one antenna transceiver.

Take a signal T to be transmitted for example. When the switch element 136 is conducted but the switch element 138 is off (i.e. the switch element 138 is not turned on), the signal T enters the microstrip antenna transceiver 10 from the switch element 136 and is fed to the vertical polarization feed-in point 126 via the microstrip line 146 so as to generate the vertically polarized signal SV in the antenna module 120 and radiate the vertically polarized signal SV to the air. However, since the radiation patch 124 has the cutting corners CH1, CH2, part of the signal T would be converted and be transmitted to the horizontal polarization feed-in point 128, then reach the switch element 138 in the off status by way of the microstrip line 148, then bounce back to the horizontal polarization feed-in point 128, and finally be sent to the antenna module 120 to generate the horizontally polarized signal SH and to radiate the horizontally polarized signal SH to the air. Then, this produces a phase difference between the horizontally polarized signal SH and the vertically polarized signal SV, because the signal transmission paths are different, and because the phase changes when signals come across the pattern slots SL1, SL2. It is worth noting that, by adjusting the cutting corners CH1, CH2 of the radiation patch 124 or the displacements 126D, 128D of the vertical polarization feed-in point 126 and the horizontal polarization feed-in point 128 with respect to a center C of the radiation patch 124, the magnitude of the vertically polarized signal SV is substantially equal to that of the horizontally polarized signal SH; in addition, by adjusting sizes SL1_L, SL1_W, SL2_L, SL2_W of the pattern slots SL1, SL2 and displacements SL1_D, SL2_D of the geometric centers of the pattern slots SL1, SL2 with respect to the center C according to reflection phases of the switch element 136, 138, the vertically polarized signal SV leads the horizontally polarized signal SH by 90 degrees (i.e., one quarter of a wavelength), such that the left-handed polarized antenna pattern can be created. In such a situation, the sizes SL1_L, SL1_W, SL2_L, SL2_W of the pattern slots SL1, SL2 and the displacements SL1_D, SL2_D are related to the reflection phases of the switch element 136, 138.

Similarly, when the switch element 138 is conducted but the switch element 136 is off, the signal T enters the microstrip antenna transceiver 10 from the switch element 138 and is fed to the horizontal polarization feed-in point 128 via the microstrip line 148 so as to generate the horizontally polarized signal SH in the antenna module 120 and radiate the horizontally polarized signal SH to the air. However, since the radiation patch 124 has the cutting corners CH1, CH2, part of the signal T would be converted and be transmitted to the vertical polarization feed-in point 126, then reach the switch element 136 in the off status by way of the microstrip line 146, then bounce back to the vertical polarization feed-in point 126, and finally be sent to the antenna module 120 to generate the vertically polarized signal SV and to radiate the vertically polarized signal SV to the air. Then, this produces a phase difference between the vertically polarized signal SV and the horizontally polarized signal SH, because the signal transmission paths are different, and because the phase changes when signals come across the pattern slots SL1, SL2. By adjusting the cutting corners CH1, CH2 of the radiation patch 124 or the displacements 126D, 128D of the vertical polarization feed-in point 126 and the horizontal polarization feed-in point 128 with respect to the center C, the magnitude of the vertically polarized signal SV is substantially equal to that of the horizontally polarized signal SH; in addition, by adjusting the sizes SL1_L, SL1_W, SL2_L, SL2_W of the pattern slots SL1, SL2 and the displacements SL1_D, SL2_D of the geometric centers of the pattern slots SL1, SL2 with respect to the center C according to the reflection phases of the switch element 136, 138, the vertically polarized signal SV lags the horizontally polarized signal SH by 90 degrees, such that the right-handed polarized antenna pattern can be created.

As set forth above, the feed-in points for signals in the microstrip antenna transceiver 10 of the present invention can be appropriately modified to handle the signals of different polarizations. Moreover, as a receiver, the microstrip antenna transceiver 10 can also transmit the left-handed polarized signal or the right-handed polarized signal received from the antenna module 120 to a backend circuit module (which is not illustrated in FIG. 1A to FIG. 1C) by controlling the switch element 136 and the switch element 138 to perform signal processing. Besides, in comparison with the radiation operations, the switch element 136 and the switch element 138 need to rotate 180 degrees to conform the signal transmission directions when the receiving operations are executed.

Figure 2:
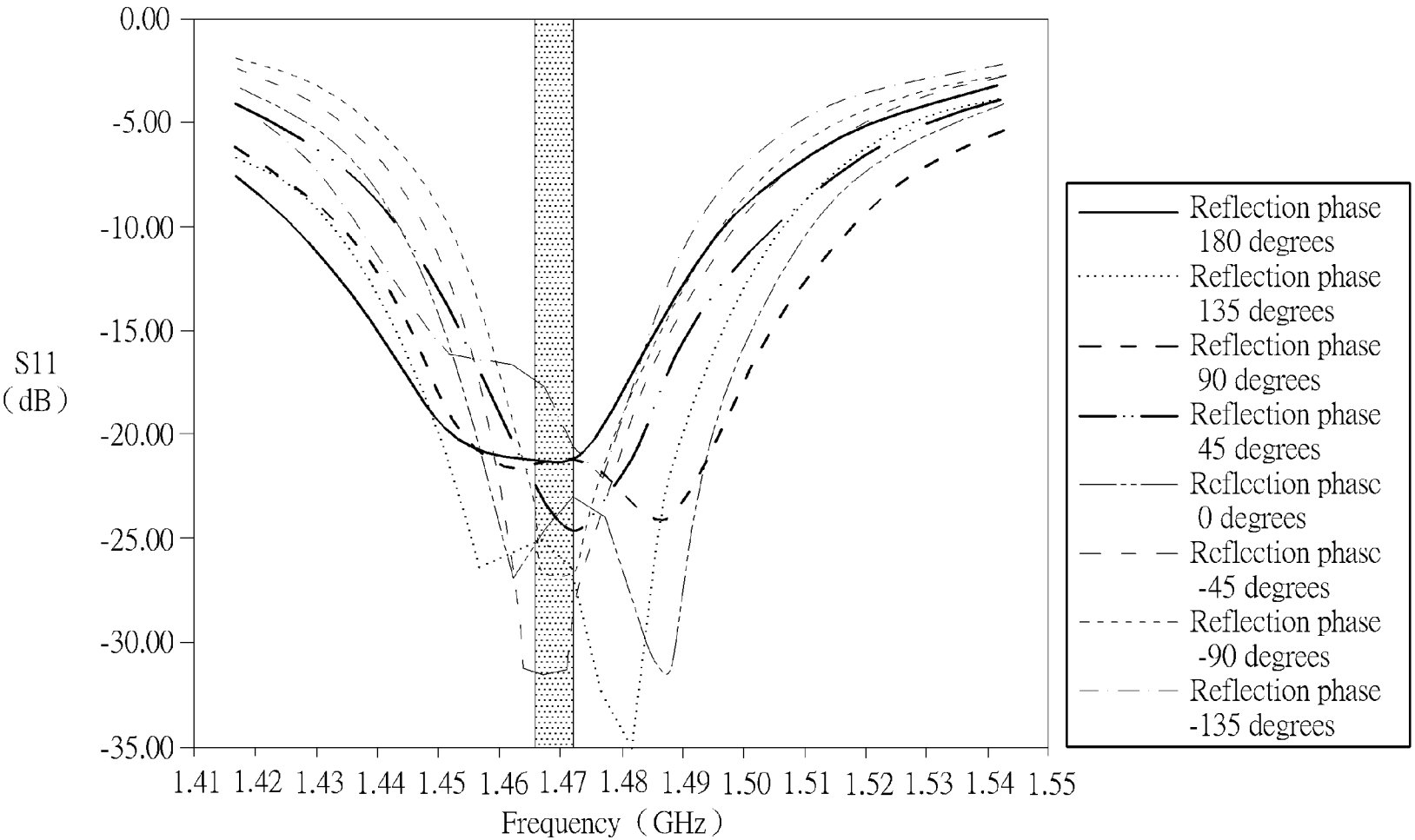
FIG. 2 is a schematic diagram illustrating antenna resonance simulation results of the microstrip antenna transceiver shown in FIG. 1A when the reflection phase of the switch elements is 180 degrees, 135 degrees, 90 degrees, 45 degrees, 0 degrees, −45 degrees, −90 degrees, and −135 degrees.
Figure 3:
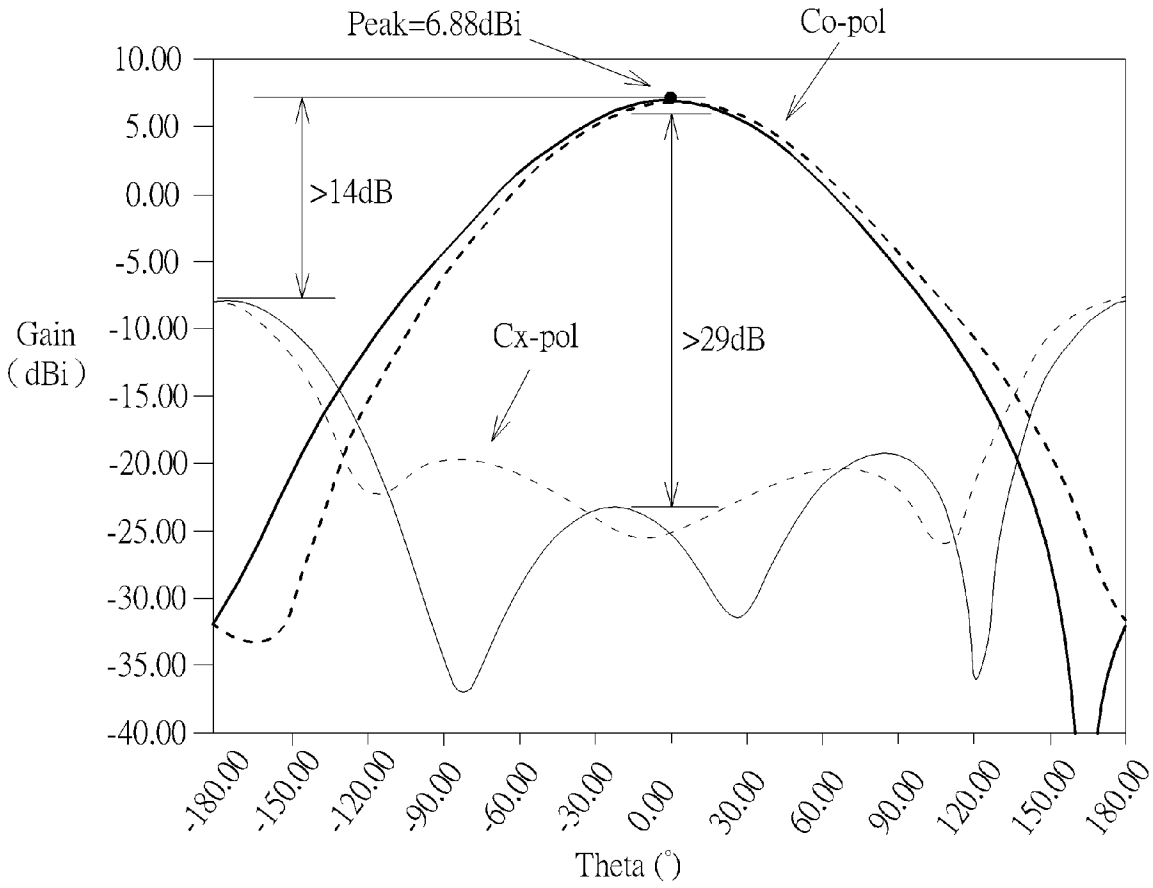
FIG. 3 to FIG. 10 are schematic diagrams illustrating antenna pattern characteristic simulation results for the microstrip antenna transceiver shown in FIG. 1A operated at 1.469 GHz when the reflection phase of the switch elements is 180 degrees, 135 degrees, 90 degrees, 45 degrees, 0 degrees, −45 degrees, −90 degrees, and −135 degrees.
Figure 4:
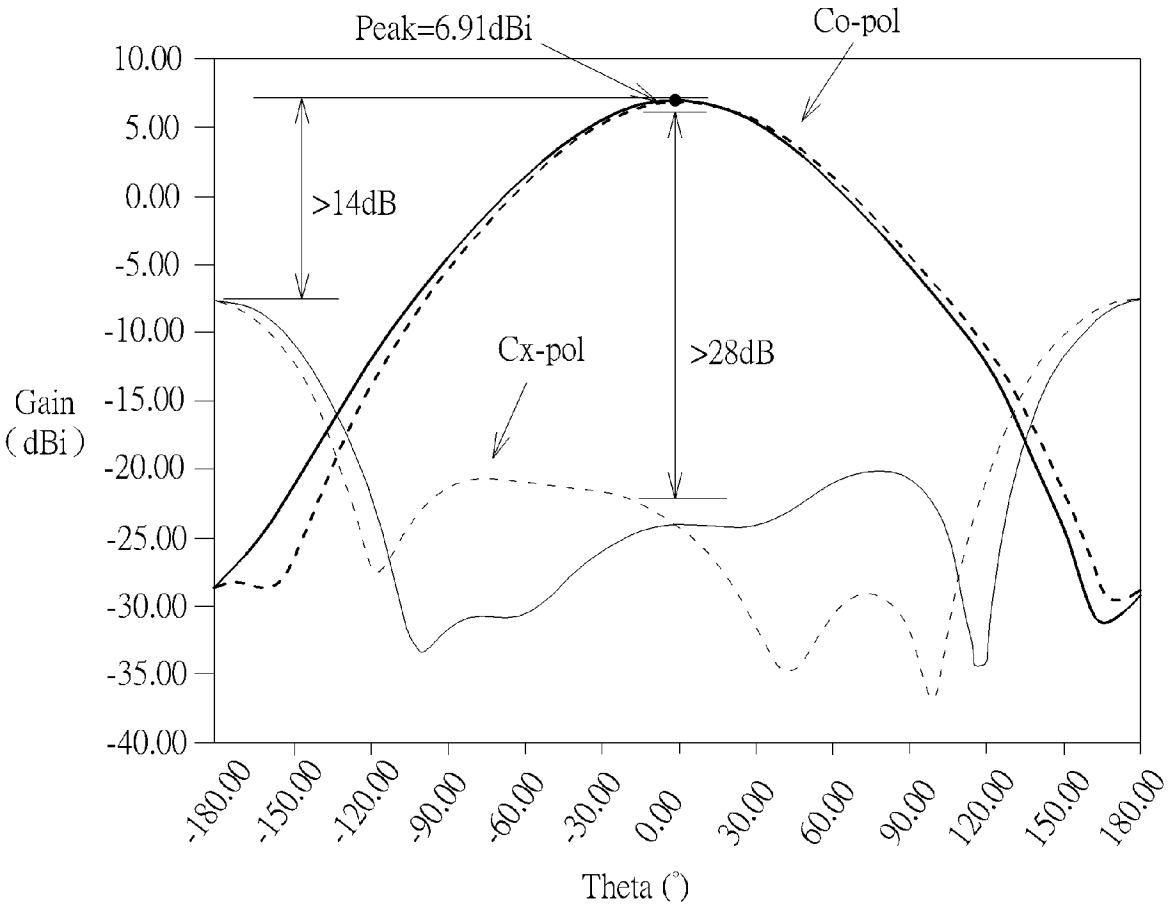
Figure 5:
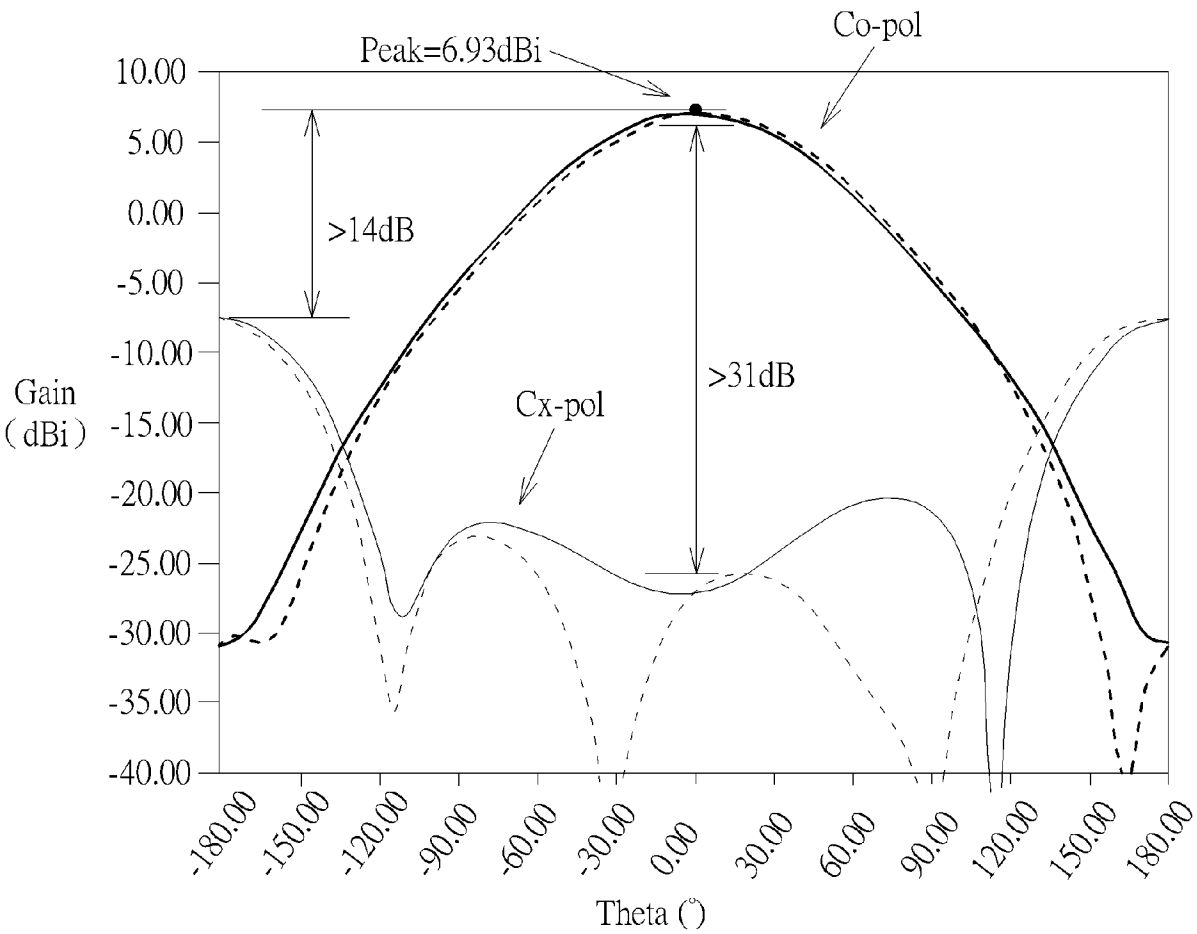
Figure 6:
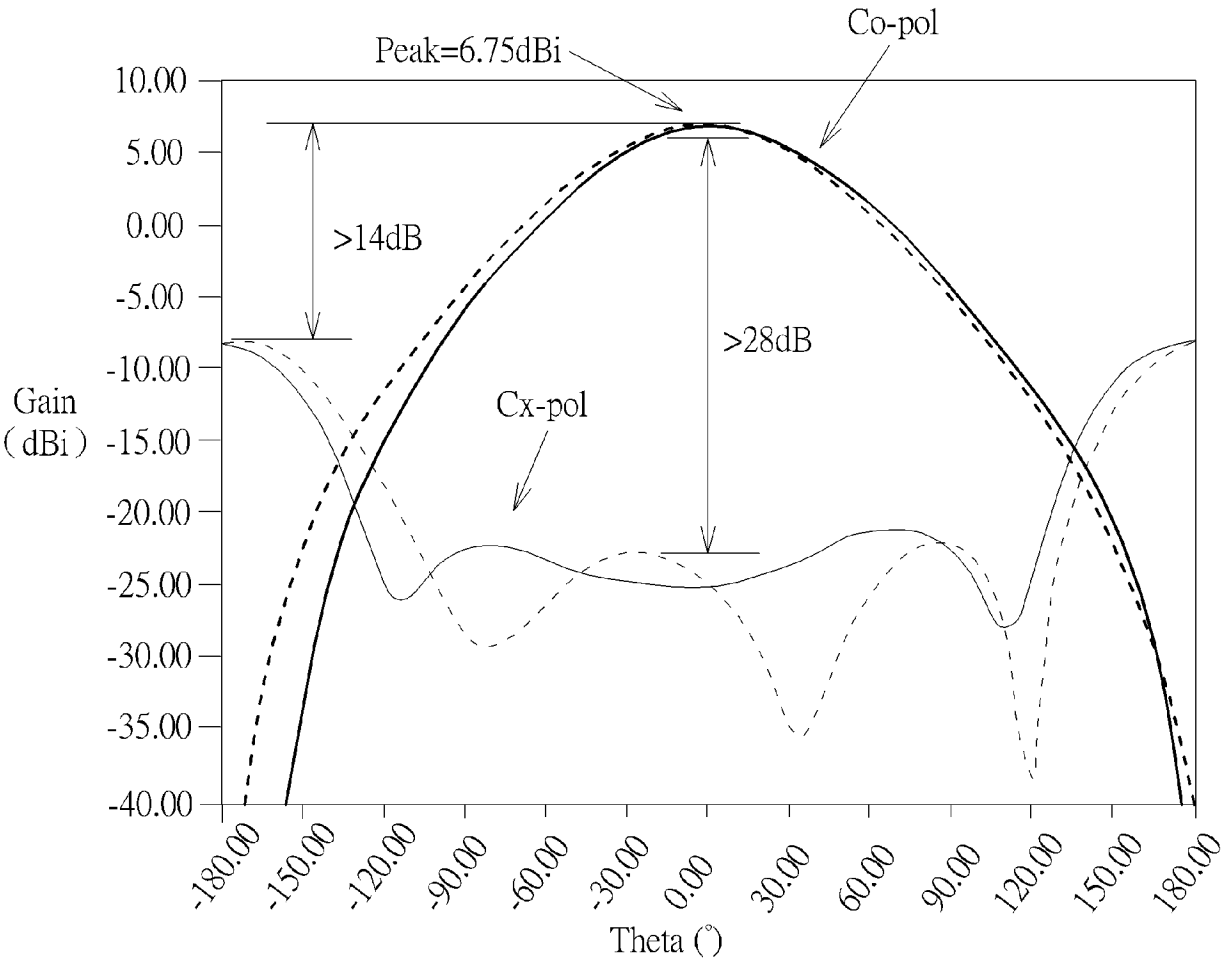
Figure 7:
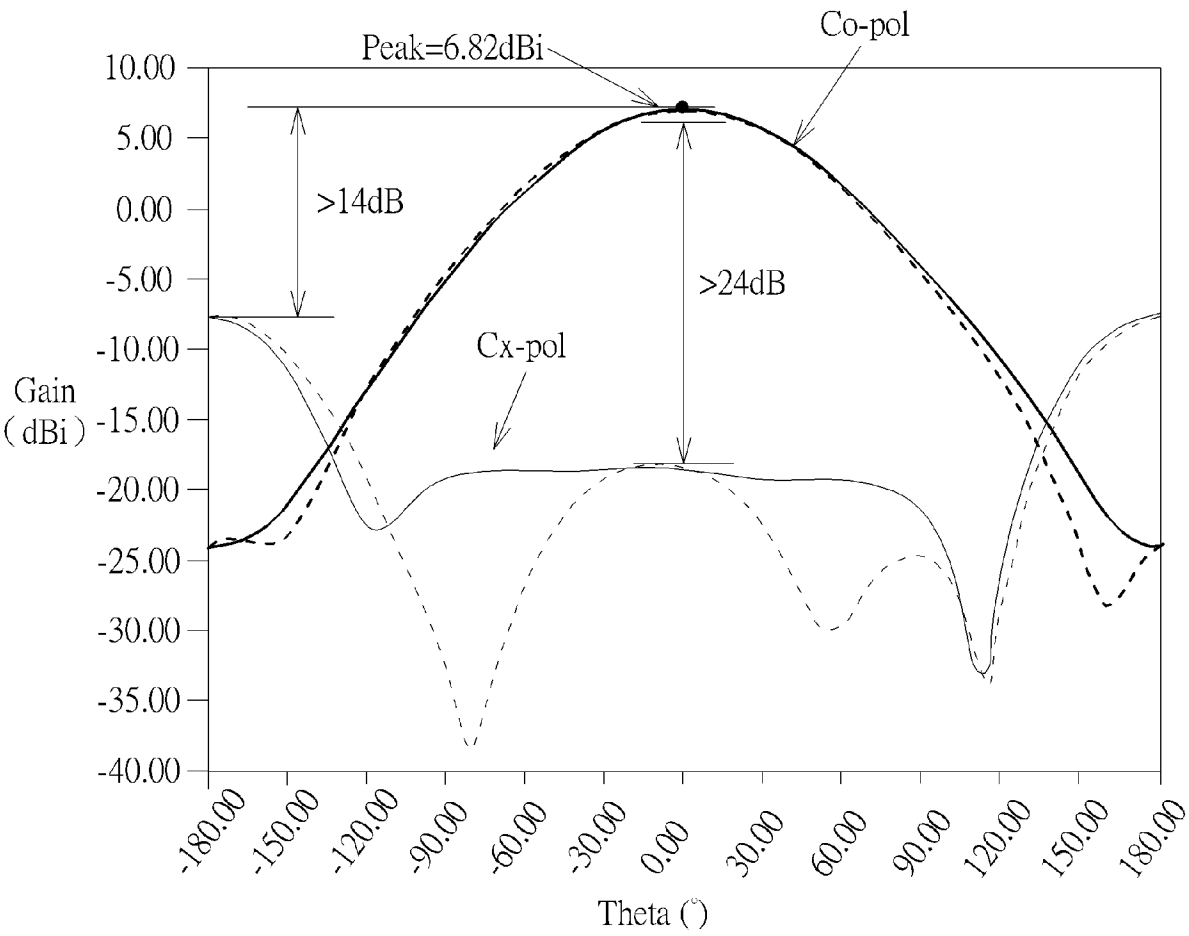
Figure 8:
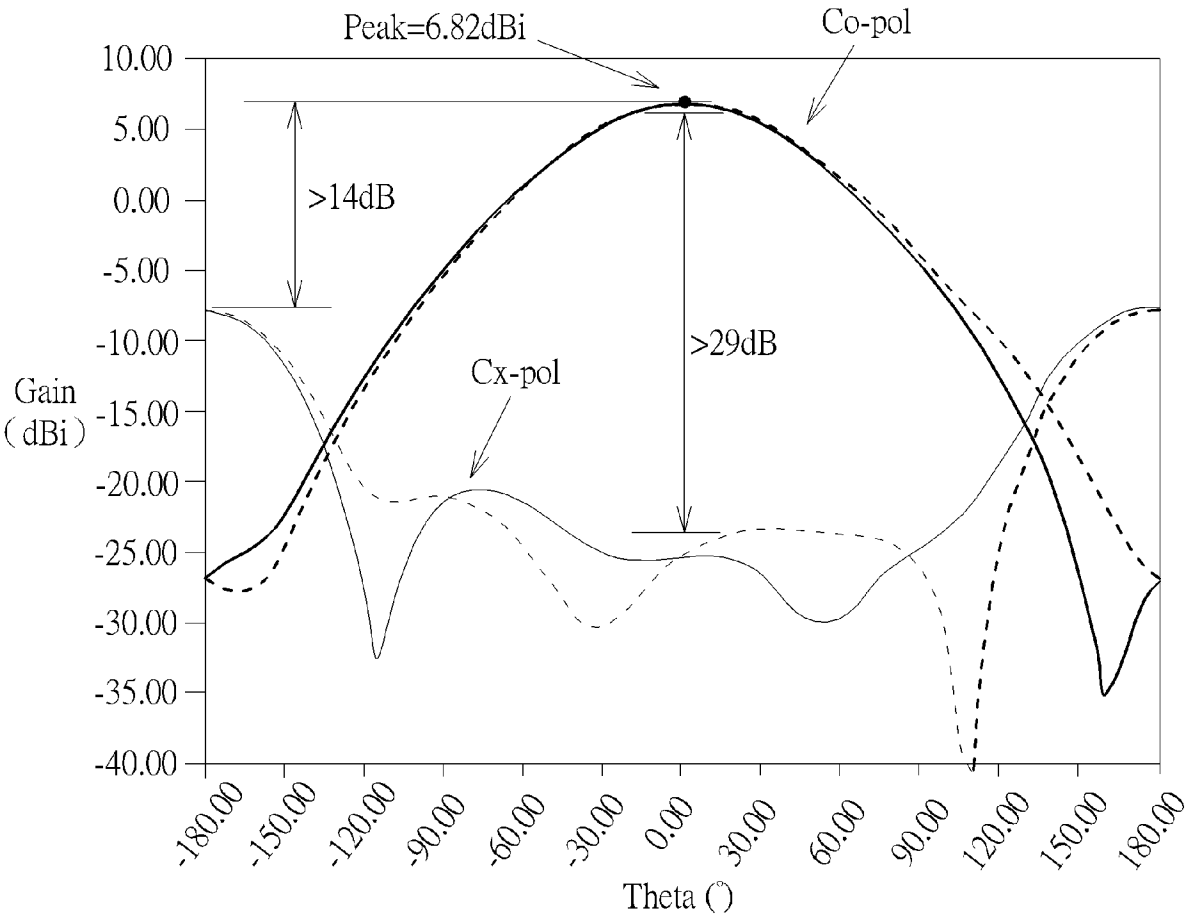
Figure 9:
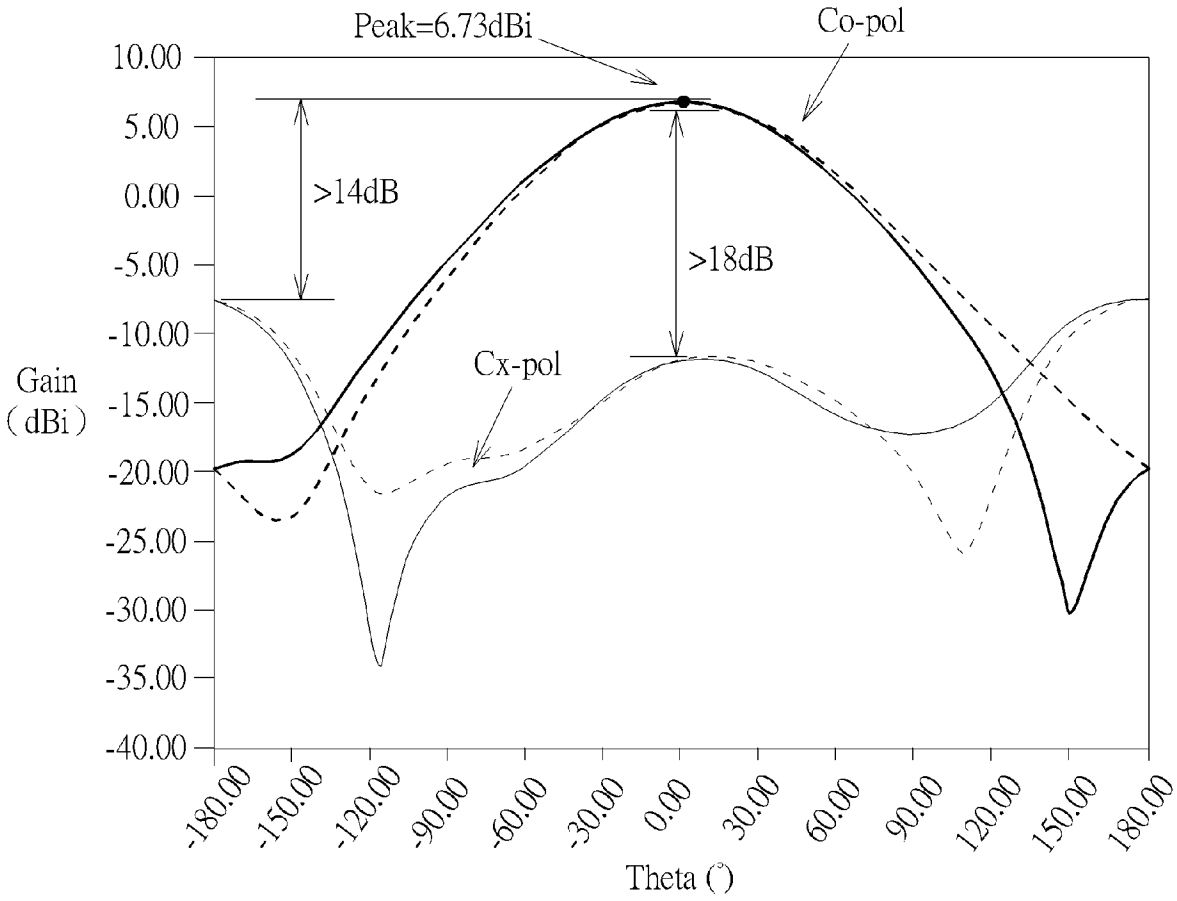
Figure 10:
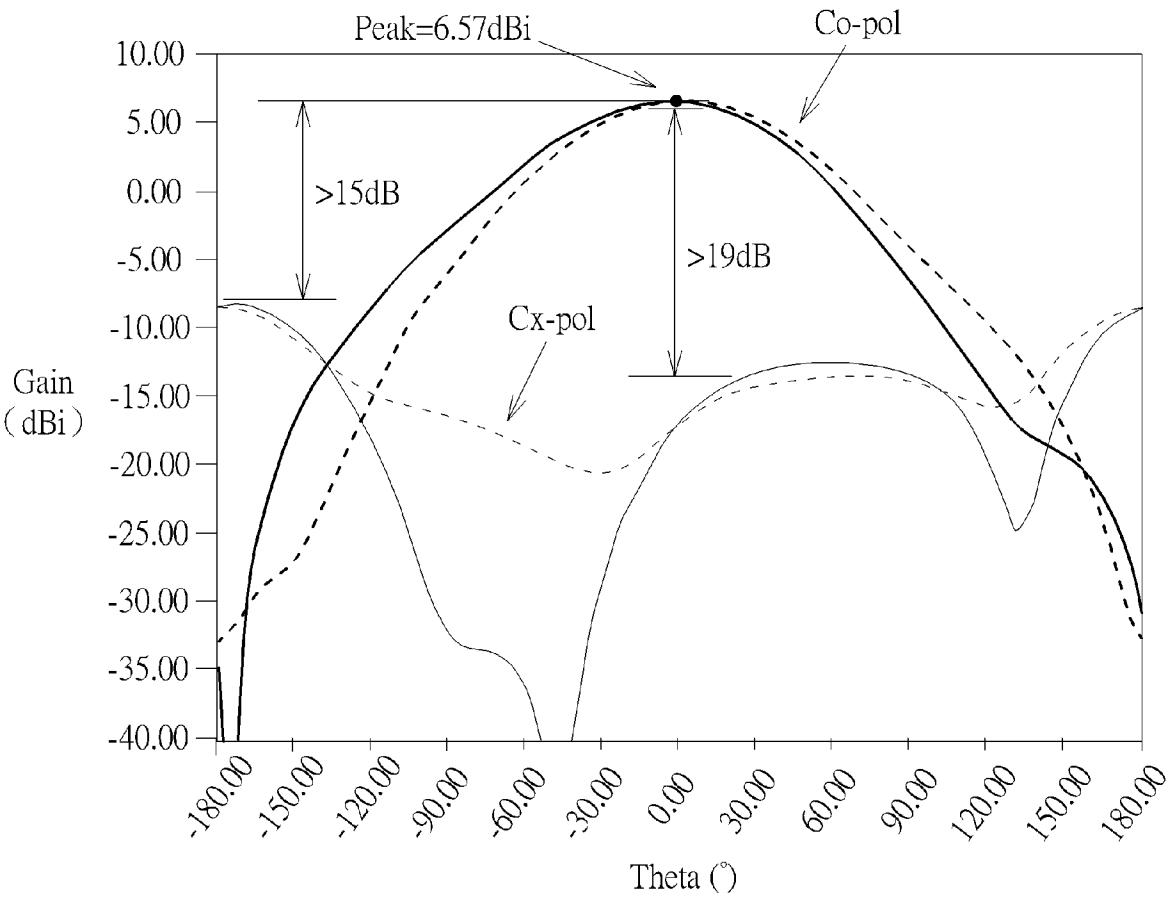

Please note that the microstrip antenna transceiver 10 is an exemplary embodiment of the invention, and those skilled in the art can make alternations and modifications accordingly. For example, according to the reflection phases of the switch elements 136, 138 (e.g., from −180 degrees to 180 degrees), the microstrip antenna transceiver 10 is properly designed to obtain the desired electromagnetic field solution. Please refer to Table 1, Table 2 and FIG. 2 to FIG. 10. FIG. 2 is a schematic diagram illustrating antenna resonance simulation results of the microstrip antenna transceiver 10 when the reflection phase of the switch elements 136, 138 is 180 degrees, 135 degrees, 90 degrees, 45 degrees, 0 degrees, −45 degrees, −90 degrees, and −135 degrees. FIG. 3 to FIG. 10 are schematic diagrams illustrating antenna pattern characteristic simulation results for the microstrip antenna transceiver 10 operated at 1.469 GHz when the reflection phase of the switch elements 136, 138 is 180 degrees, 135 degrees, 90 degrees, 45 degrees, 0 degrees, −45 degrees, −90 degrees, and −135 degrees. In FIG. 3 to FIG. 10, common polarization radiation pattern of the microstrip antenna transceiver 10 at 0° cut plane is presented by thick solid line, common polarization radiation pattern of the microstrip antenna transceiver 10 at 90° cut plane is presented by thick dashed line, cross polarization radiation pattern of the microstrip antenna transceiver 10 at 0° cut plane is presented by thin solid line, and cross polarization radiation pattern of the microstrip antenna transceiver 10 at 90° cut plane is presented by thin dashed line. Table 1 is an antenna characteristic table for the microstrip antenna transceiver 10 with different sizes and different reflection phases of the switch elements 136, 138 shown in FIG. 3 to FIG. 6. Table 2 is an antenna characteristic table for the microstrip antenna transceiver 10 with different sizes and different reflection phases of the switch elements 136, 138 shown in FIG. 7 to FIG. 10. As can be seen from FIG. 2, Table 1 and Table 2, when the reflection phase of the switch elements 136, 138 in the off status is 180 degrees, 135 degrees, 90 degrees, 45 degrees, 0 degrees, −45 degrees, −90 degrees, and −135 degrees, the maximum value of return loss (S11) of the microstrip antenna transceiver 10 operated in a range of 1.466 GHz to 1.472 GHz is −21.0 dB, −25.0 dB, −21.2 dB, −22.4 dB, −22.9 dB, −27.7 dB, −24.6 dB and −17.3 dB, respectively. Moreover, the microstrip antenna transceiver 10 can meet the requirements for antenna gain and common polarization to cross polarization (Co/Cx) value, and produce circularly polarized signals of axial ratio approximating 1. In other words, instead of adjusting the antenna dimensions, the phase shift between the vertically polarized signal SV and the horizontally polarized signal SH can be changed to obtain the required electromagnetic field solution by adjusting the sizes SL1_L, SL1_W, SL2_L, SL2_W and the displacements SL1_D, SL2_D of the pattern slots SL1, SL2 according to the reflection phases of the switch element 136, 138.

TABLE 1

| the reflection phase (degree) | 180 | 135 | 90 | 45 |
|---|---|---|---|---|
| the size SL1_W (mm) | 1.90 | 1.97 | 2.39 | 2.22 |
| the size SL1_L (mm) | 22.0 | 19.0 | 22.1 | 24.2 |
| the displacements SL1_D (mm) | 11.2 | 13.0 | 33.5 | 18.5 |
| the size SL2_W (mm) | 2.27 | 2.31 | 2.36 | 2.10 |
| the size SL2_L (mm) | 8.00 | 8.50 | 7.29 | 7.15 |
| the displacements SL2_D (mm) | 26.6 | 30.8 | 33.2 | 23.8 |
| return loss (dB) | −21.0 | −25.0 | −21.2 | −22.4 |
| polarization | left-handed polarization | left-handed polarization | left-handed polarization | right-handed polarization |
| maximum gain (dBi) | 6.88 | 6.91 | 6.93 | 6.75 |
| common polarization to cross polarization (Co/Cx) value (dB) | 29 | 28 | 31 | 28 |
| front-to-back ratio (dB) | 14 | 14 | 14 | 14 |

TABLE 2

| the reflection phase (degree) | 0 | −45 | −90 | −135 |
|---|---|---|---|---|
| the size SL1_W (mm) | 2.40 | 1.97 | 2.25 | 2.16 |
| the size SL1_L (mm) | 23.5 | 21.9 | 21.0 | 28.8 |
| the displacements | 15.3 | 13.2 | 14.6 | 6.86 |

TABLE 2-continued

| the reflection phase (degree) | 0 | −45 | −90 | −135 |
|---|---|---|---|---|
| SL1_D (mm) | | | | |
| the size SL2_W (mm) | 2.74 | 4.72 | 4.52 | 2.54 |
| the size SL2_L (mm) | 12.6 | 13.1 | 11.8 | 9.06 |
| the displacements SL2_D (mm) | 26.6 | 28.7 | 29.1 | 27.4 |
| return loss (dB) | −22.9 | −27.7 | −24.6 | −17.3 |
| polarization | right-handed polarization | right-handed polarization | right-handed polarization | left-handed polarization |
| maximum gain (dBi) | 6.82 | 6.82 | 6.73 | 6.57 |
| common polarization to cross polarization (Co/Cx) value (dB) | 24 | 29 | 18 | 19 |
| front-to-back ratio (dB) | 14 | 14 | 14 | 15 |

The switch elements 136, 138 can be selected from transistors or diode elements, but not limited herein. The switch element 136 is disposed along the vertical direction X and the switch element 138 is disposed on the horizontal direction Y, but not limited thereto. The lengths of the microstrip lines 146, 148 remain constant even if the reflection phases of the switch elements 136, 138 differ. The distances L1, L2 of the microstrip lines 146, 148 from the switch elements 136, 138 to the openings 106, 108 are approximately zero, and hence the microstrip lines 146, 148 merely electrically connects one element to another without changing signal phase, thereby providing a relative small sized microstrip antenna transceiver 10, reducing energy loss of the microstrip lines 146, 148, improving antenna gain, and avoiding noise. However, the present invention is not limited to this and the lengths of the microstrip lines 146, 148 may be adjusted according to different design requirements.

Figure 11:
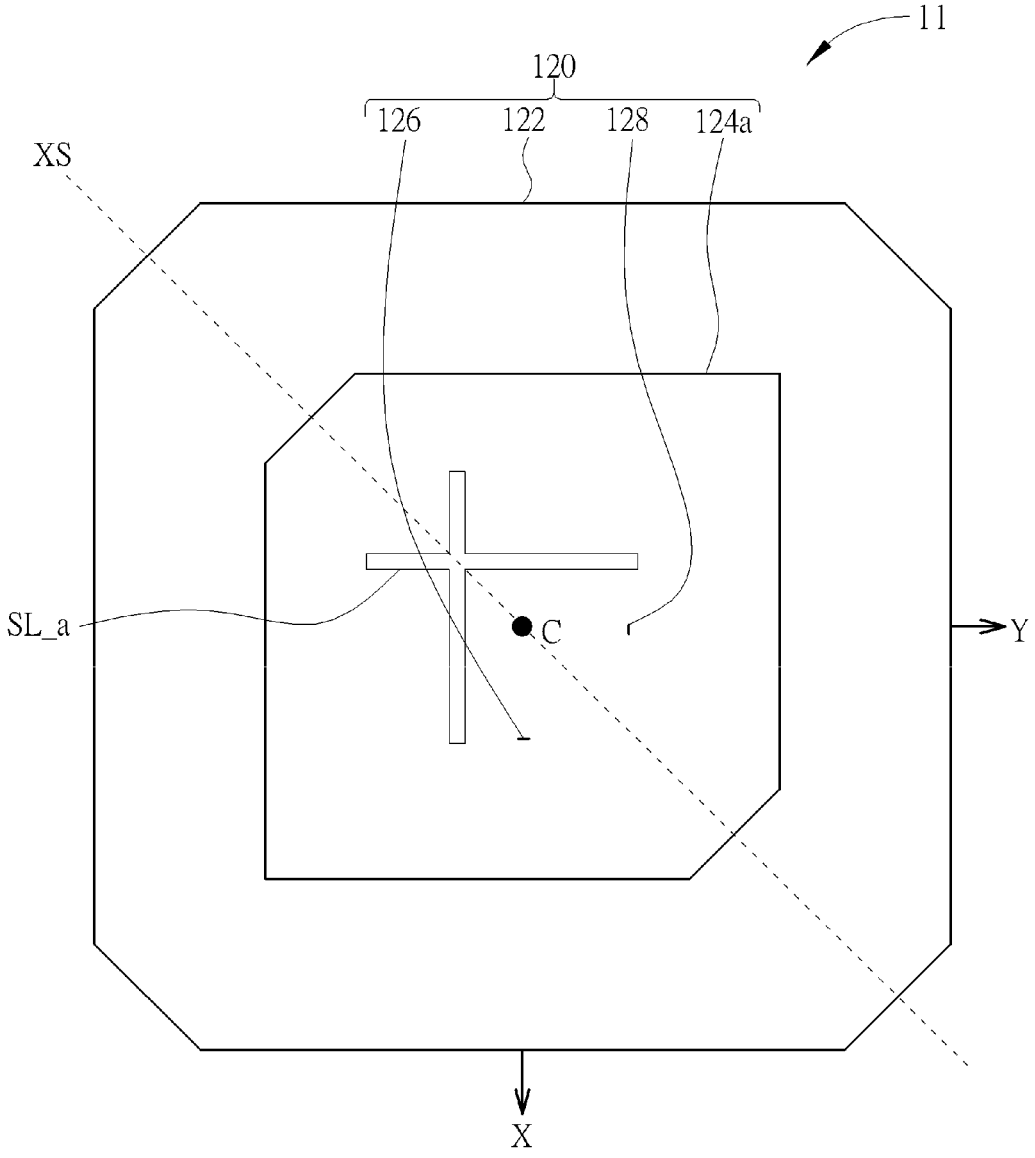
FIG. 11 is a schematic diagram illustrating a top view of a front surface of a microstrip antenna transceiver according to an embodiment of the present invention.
Figure 12:
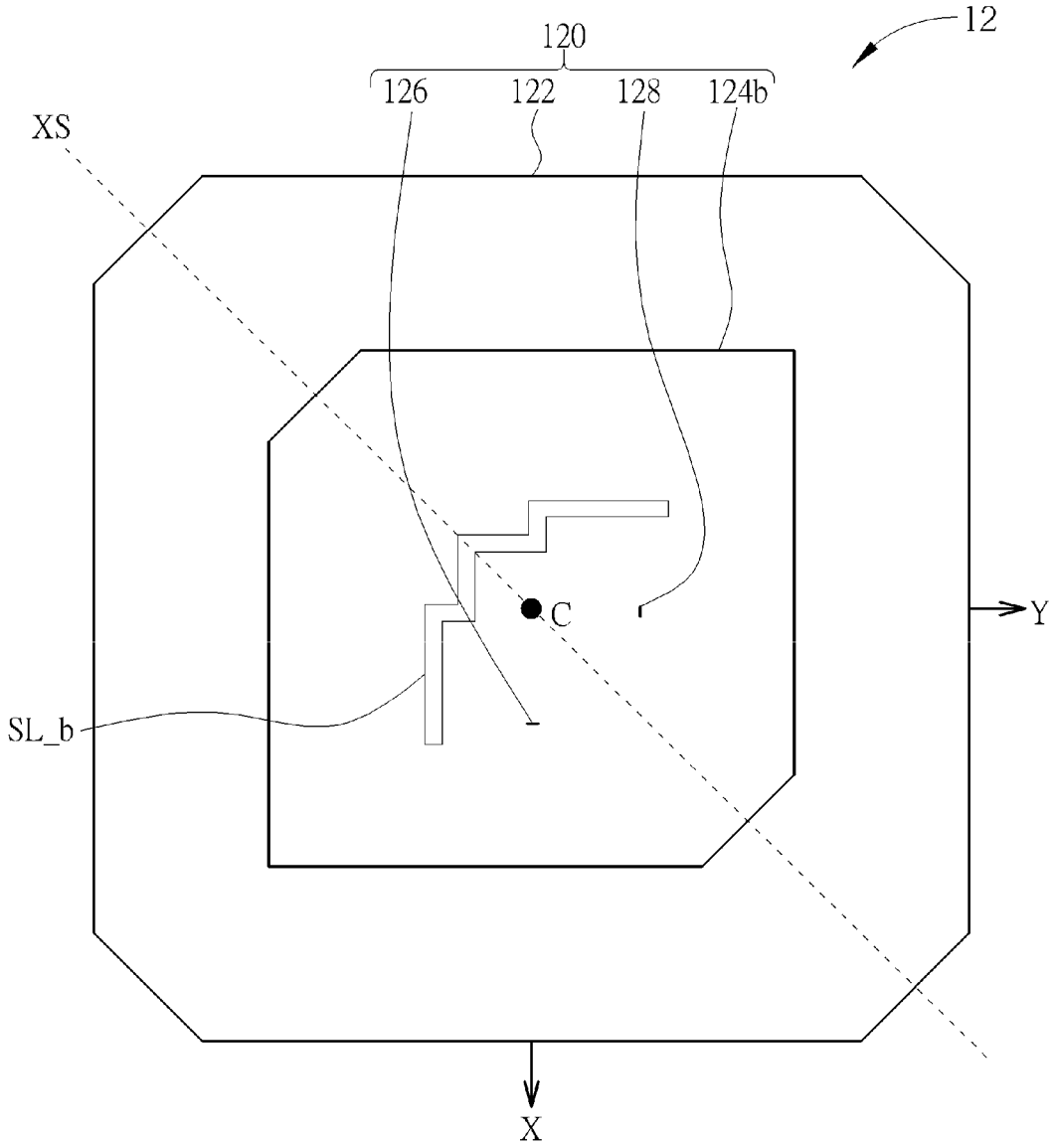
FIG. 12 is a schematic diagram illustrating a top view of a front surface of a microstrip antenna transceiver according to an embodiment of the present invention.

Besides, the pattern slots SL1, SL2 of the radiation patch 124 have a shape substantially conforming to an L-shaped structure, but not limited thereto. For example, FIG. 11 and FIG. 12 are schematic diagrams illustrating top views of front surfaces of microstrip antenna transceivers 11 and 12 according to embodiments of the present invention. Pattern slots SL_a, SL_b of the microstrip antenna transceivers 11, 12 have shapes substantially conforming to a cross-shaped structure and a stepwise structure, respectively. To maintain resonance frequency and to ensure resonance of radiation patches 124*a* and 124*b* of the microstrip antenna transceivers 11 and 12, the pattern slot SL_a and SL_b are closed pattern and never cut the radiation patches 124*a* and 124*b* into pieces. For the vertically polarized signal SV resonating along the vertical direction X, the pattern slot can be extended along the horizontal direction Y; for the horizontally polarized signal SH resonating along the horizontal direction Y, the pattern slot can be extended along the vertical direction X. Consequently, the pattern slot can be symmetric with respect to the symmetrical axis XS. The pattern slots SL_a and SL_b can replace the pattern slots SL1, SL2 shown in FIG. 1A. Alternatively, the pattern slots SL_a and SL_b can be added into the radiation patch 124 shown in FIG. 1A, such that the radiation patch 124 comprises a plurality of pattern slots.

To sum up, the microstrip antenna transceiver of the present invention can transmit (or receive) signals of different polarizations in different time and is cost effective by controlling the switch elements and by adjusting the cutting corners of the radiation patch, the displacements of the feed-in points or the sizes and the displacements of the pattern slots. Furthermore, the lengths of the microstrip lines are shortened to minimize the dimensions of the microstrip antenna transceiver, thereby providing a relative small sized microstrip antenna transceiver, reducing energy loss of the microstrip lines, improving antenna gain, and avoiding noise.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A microstrip antenna transceiver with switchable polarizations, comprising:

a substrate comprising a first surface and a second surface;

a first switch element disposed on the first surface of the substrate;

a second switch element disposed on the first surface of the substrate; and an antenna module disposed on the second surface of the substrate, the antenna module comprising:

a radiation patch comprising a first pattern slot, wherein a size and a displacement of the first pattern slot are related to a reflection phase of the first switch element and a reflection phase of the second switch element to generate a right-handed polarized signal or a left-handed polarized signal, and wherein the first pattern slot is formed within the radiation patch and the first pattern slot is a closed pattern slot;

a vertical polarization feed-in point; and a horizontal polarization feed-in point, wherein the vertical polarization feed-in point and the horizontal polarization feed-in point are symmetric with respect to a symmetrical axis of the radiation patch;

wherein the radiation patch further comprises a second pattern slot, and the first pattern slot and the second pattern slot are symmetric with respect to the symmetrical axis of the radiation patch, wherein the second pattern slot is formed within the radiation patch and the second pattern slot is a closed pattern slot.

2. The microstrip antenna transceiver of claim 1, wherein the vertical polarization feed-in point is disposed on the second surface of the substrate and is located at a first position along a first direction, the horizontal polarization feed-in point is disposed on the second surface of the substrate and is located at a second position along a second direction, and the first direction is perpendicular to the second direction.

3. The microstrip antenna transceiver of claim 1, wherein the shape of the radiation patch of the antenna module is substantially conforming to a quadrilateral with two opposite corners chamfered to form a hexagon.

4. The microstrip antenna transceiver of claim 3, wherein the first pattern slot is disposed on one side of a line connecting the vertical polarization feed-in point to the horizontal polarization feed-in point, and the second pattern slot is disposed on the other side of the line.

5. The microstrip antenna transceiver of claim 4, wherein the first pattern slot and the second pattern slot have a shape substantially conforming to an L-shaped structure, a cross-shaped structure or a stepwise structure.

6. The microstrip antenna transceiver of claim 3, wherein energy is equally partitioned into a first linearly polarized signal and a second linearly polarized signal with two cutting corners of the radiation patch, the first linearly polarized signal and the second linearly polarized signal have phase difference of 90 degrees owing to a size of the first pattern slot to form a right-handed polarized signal or a left-handed polarized signal from the first linearly polarized signal and the second linearly polarized signal, and the polarization directions of the first linearly polarized signal and the second linearly polarized signal are orthogonal.

7. The microstrip antenna transceiver of claim 1, wherein the first switch element and the second switch element are selected from transistors or diode elements.

8. The microstrip antenna transceiver of claim 1, further comprising:

a metal grounding plate disposed on the second surface of the substrate and disposed between the antenna module and the substrate;

a first microstrip line electrically connected between the vertical polarization feed-in point and the first switch element; and a second microstrip line electrically connected between the horizontal polarization feed-in point and the second switch element.

* * * * *